US007104939B1

(12) United States Patent
Martinez

(10) Patent No.: US 7,104,939 B1
(45) Date of Patent: Sep. 12, 2006

(54) APPARATUS FOR BACK THERAPY AND MULTIPLE EXERCISES

(76) Inventor: Raymond Randy Martinez, 3730 Providence La., Pasadena, TX (US) 77505

( * ) Notice: Subject to any disclaimer, the term of this patent is extended or adjusted under 35 U.S.C. 154(b) by 37 days.

(21) Appl. No.: 10/846,193

(22) Filed: May 13, 2004

Related U.S. Application Data

(60) Provisional application No. 60/470,169, filed on May 13, 2003.

(51) Int. Cl.
*A63B 26/00* (2006.01)

(52) U.S. Cl. ..... 482/142; 482/148; 482/62

(58) Field of Classification Search ..... 482/142, 482/148, 35–38, 41, 52, 57, 62; D21/665, D21/671, 691
See application file for complete search history.

(56) References Cited

U.S. PATENT DOCUMENTS

| | | | | | |
|---|---|---|---|---|---|
| 3,708,167 | A * | 1/1973 | Potgieter | 482/100 |
| 3,857,561 | A * | 12/1974 | Cecchettini et al. | 482/142 |
| 4,188,029 | A * | 2/1980 | Brower et al. | 482/38 |
| 4,621,810 | A * | 11/1986 | Cummins | 482/137 |
| 4,750,736 | A * | 6/1988 | Watterson | 482/73 |
| 4,789,152 | A * | 12/1988 | Guerra | 482/142 |
| 5,080,352 | A * | 1/1992 | Freed | 482/41 |
| RE34,212 | E * | 4/1993 | Potts | 482/26 |
| 5,322,489 | A * | 6/1994 | Webb et al. | 482/38 |
| 5,496,241 | A * | 3/1996 | Sellers | 482/51 |
| 5,626,541 | A * | 5/1997 | Ramlogan et al. | 482/72 |
| 5,647,822 | A * | 7/1997 | Avganim | 482/60 |
| 5,840,001 | A * | 11/1998 | Schedel | 482/142 |
| 6,027,433 | A * | 2/2000 | Flynn | 482/98 |
| 6,220,992 | B1 * | 4/2001 | Shafik | 482/83 |
| 6,394,932 | B1 * | 5/2002 | Chu | 482/38 |

* cited by examiner

*Primary Examiner*—Lori Amerson
(74) *Attorney, Agent, or Firm*—Kenneth A. Roddy

(57) ABSTRACT

A freestanding back therapy and multiple exercise station on which various therapeutic, stretching, bending, twisting, extension and inversion exercises may be carried out utilizing the user's weight for fully flexing and decompressing the spine and strengthening the trunk and back muscles of the user. The station has a frame of tubular construction with a floor engaging base, front and rear vertical upright members, a horizontal top member extending between upper ends thereof, and a cushioned forearm pad on each said horizontal member with handgrips at outer of the horizontal top members. A lower pair of vertically spaced padded cross members extend transversely between the rear vertical upright members to serve as foot supports. A central upright member is connected at a lower end with at least one padded cross member and has a forward and angularly upward extending upper portion. A backrest pad is mounted the central upright member. An upper pair of parallel vertically spaced padded tubular members extend laterally outward from each side of the central upright member near its upper portion to selectively serve either as handgrips or as elevated or leg or foot supports when performing exercises. A removable rotatable cylindrical cushioned roller is may be mounted transversely between the horizontal top members to serve as a back engaging roller or a seating surface when performing exercises. Various auxiliary exercise apparatus may be removably connected with the station for performing a variety of exercises.

9 Claims, 10 Drawing Sheets

40
35
35A
29B
36
35A
29
37
33A
33A
31A
33
32
38
34
31A
31
10
17
25A
28A
30
18
26
13B
13A
19
17
28A
40
25B
28
25
13B
18
29A
24
19
22
27A
40
25A,26
27
24
27A
41
22
13A
39
16
13
15
13
23
20
21
16
41
14
39
15
W
11A
21
12
11B
11
23
39
20
11A
39
11

APPARATUS FOR BACK THERAPY AND MULTIPLE EXERCISES

CROSS REFERENCE TO RELATED APPLICATION

This application claims priority of U.S. Provisional Application Ser. No. 60/470,169 filed May 13, 2003.

BACKGROUND OF THE INVENTION

1. Field of the Invention

This invention relates generally to exercise and back therapy apparatus, and more particularly to a back therapy and exercise station on which performance of various therapeutic, stretching, bending, twisting and inversion exercises may be carried out utilizing the user's weight for fully flexing and decompressing the spine and strengthening the trunk and back muscles of the user.

2. Background Art

The human spine or vertebral column is a complex structure which is designed to support loads, protect the spinal cord, and attenuate the forces that are commonly transferred to and from the trunk and arms to the lower extremities. The vertebral column is made up of 24 true vertebrae, seven cervical, twelve thoracic, and five lumbar. There are five sacral vertebrae, which in the adult are fused together, thereby not representing true vertebrae. There are three major curves associated with the vertebral column that are functional in the support of the body. The lumbar and cervical curves are convex anteriorly, whereas the thoracic curve is convex posteriorly. There are normal deviations from vertical in the coronal plane as well.

Each vertebra is separated from adjacent vertebrae by intervertebral discs, which function as shock absorbers between the vertebral bodies and maintain the space between the vertebrae open sufficient to insure that the nerves and the blood vessels can pass between them without injury. There are two major components of discs, a viscous inner portion called the nucleus pulposis and a tough fibrous tissue surrounding the nucleus called the annulus fibrosis. Due to the forces that the vertebral column commonly experiences, the annulus will sometimes become herniated allowing the nucleus to seep out of confinement. The flow of the nucleus out of the annulus will often impinge upon spinal nerves causing clinical problems ranging from pain to quasiparalysis. This is commonly referred to as a "slipped disc."

The individual vertebrae and intervertebral discs are stabilized by vertebral ligaments. The posterior ligaments are those which tend to resist the vertebral column's tendency to flex, and the anterior ligaments are those which help prevent extension. The ligaments are strong and somewhat inelastic.

The musculature of the vertebral column is also extensive and complex. The anterior vertebral muscles are those which tend to cause vertebral flexion and include the abdominal muscles (rectus abdominus, the external obliques, and the internal obliques). The psoas major and minor muscles have attachments to the anterior aspect of the vertebral column in the lumbar region, and have a tendency to cause extension of the lumbar vertebrae. The primary extensors are those muscles which are classified as posterior vertebral muscles. A simplification of the muscles places them in a single group of muscles called the erector spinae.

The loads on the vertebral column come from three sources: body weight, external forces, and internal forces. Any particular vertebrae will be affected by the weight of any body mass that is superior to its location. External forces comprise any force, or weight, that is added to the vertebral column. Internal forces represent forces that are created by muscles and ligaments. The erector spinae, for example, which are found bilaterally just lateral to the vertebral column, cause the vertebral column to undergo compressive forces when they contract.

There are three basic types of forces that affect the vertebral column. In general, these are compression, shear, and torsion forces. Compression forces act predominately upon the intervertebral discs. Shear forces, however, have their predominant effect at the intervertebral foramen, the site at which spinal nerves exit from the vertebral column. Torsion forces are twisting forces and may affect both of these structures.

Tension is a force quite common in the vertebral column. During flexion of the trunk, for example, the anterior aspect of the intervertebral body undergoes compression as a result of the adjacent vertebral bodies moving closer to one another. The posterior aspect of the intervertebral disc, however, undergoes tension, as do the posterior vertebral ligaments which serve to restrict the degree of flexion which may occur.

Without proper muscular support the vertebrae become unstable, and if the discs flatten out or become damaged, decreased circulation an/or nerve function can result. The discs also flatten over a period of time as one ages principally due to the weight of the head, neck and shoulders, and gravitational stress constantly compressing the spine. Weak abdominal muscles, poor posture and lack of exercise all contribute to further weaken the muscular support for the vertebrae and can make a person more susceptible to back sprains or more serious injury. Painful and disabling low back disorders are caused by disc herniations (subligamentous and extruded), degenerative disc disease, sciatica and posterior facet arthrosis.

Freestanding exercise machines known as "Vertical Knee Raise" (VKR) stations are known in the art which utilize the weight of the user's body, without stressing the back, in performing various exercises such as knee raises, leg raises and oblique twists and bends, which, tighten the user's midsection and provide stretching and contraction of the back muscles to some extent. These types of freestanding stations also allow the user to perform chinning and pull-up exercises, which strengthen the muscles of the arms and upper torso.

Freestanding exercise machines known as "imversion machines" are known in the art, which utilize the weight of the user's body to decompress the spine via controlled traction in the cervical and/or lumbar spine areas. These types of devices effect decompression by suspending the body from the heels in an up-side-down manner, or suspend the body above a support surface by the thighs, pelvis or abdomen. Although some limited amount of exercise may be performed in an inverted position, most of these types of devices are designed primarily for spinal decompression and are not entirely satisfactory for fully flexing the spine and strengthening the back extensor muscles and toning the abdominal muscles, and the exercises performable on such devices are merely an incident of the inverted supported position.

Tension machines are also known in that art for the treatment of painful and disabling low back disorders caused by disc herniations (subligamentous and extruded), degenerative disc disease, sciatica and posterior facet arthrosis. These types of machines apply controlled tension along the axis of the spinal column to distract the vertebral segments and posterior facets of the lumbar spine and decompress the intervertebral discs. Some of these machines create a vacuum effect within the disc drawing the herniation back into place and drawing fluids back into the disc so they can heal. Although such treatment effectively reduces pain and improves the mobility of the back in a significant number of patients, these types of tensioning machines are designed specifically for spinal decompression and do not provide means for exercising and strengthening the back extensor muscles and toning the abdominal muscles.

The present invention is distinguished over the prior art in general by a freestanding back therapy and multiple exercise station on which on performance of various therapeutic, stretching, bending, twisting, extension and inversion exercises may be carried out utilizing the user's weight for fully flexing and decompressing the spine and strengthening the trunk and back muscles of the user. The station has a frame of tubular construction with a floor engaging base, front and rear vertical upright members, a horizontal top member extending between upper ends thereof, and a cushioned forearm pad on each said horizontal member with handgrips at outer of the horizontal top members. A lower pair of vertically spaced padded cross members extend transversely between the rear vertical upright members to serve as foot supports. A central upright member is connected at a lower end with at least one padded cross member and has a forward and angularly upward extending upper portion. A backrest pad is mounted the central upright member. An upper pair of parallel vertically spaced padded tubular members extend laterally outward from each side of the central upright member near its upper portion to selectively serve either as handgrips or as elevated or leg or foot supports when performing exercises. A removable rotatable cylindrical cushioned roller is may be mounted transversely between the horizontal top members to serve as a back engaging roller or a seating surface when performing exercises. Various auxiliary exercise apparatus may be removably connected with the station for performing a variety of exercises.

SUMMARY OF THE INVENTION

It is therefore an object of the present invention to provide a freestanding back therapy and exercise station on which on performance of various therapeutic, stretching, bending, twisting, extension and inversion exercises may be carried out utilizing the user's weight for fully flexing and decompressing the spine and strengthening the trunk and back muscles of the user.

It is another object of this invention to provide a freestanding back therapy and exercise station constructed of tubular members that is easily and quickly assembled without special tools and can be stored and shipped in a compact package in a disassembled condition.

Another object of this invention is to provide a freestanding back therapy and exercise station having a stable support frame capable of safely suspending a user's body above a ground-support surface in various cantilevered and inverted positions and withstanding the torque exerted by rigorous exercise on the device.

Another object of this invention is to provide a freestanding back therapy and exercise station that will significantly reduce back pain and discomfort.

Another object of this invention is to provide a freestanding back therapy and exercise station having a frame on which various auxiliary exercise apparatus may be removably connected with the station for performing a variety of exercises.

A further object of this invention is to provide a freestanding back therapy and exercise station that will enhance blood flow and increase delivery of oxygen nutrition and enzymes to the spinal column areas and other parts of the user's body.

A still further object of this invention is to provide a freestanding back therapy and exercise station that is simple in construction and inexpensive to manufacture.

Other objects of the invention will become apparent from time to time throughout the specification and claims as hereinafter related.

The above noted objects and other objects of the invention are accomplished by the present freestanding back therapy and multiple exercise station on which on performance of various therapeutic, stretching, bending, twisting, extension and inversion exercises may be carried out utilizing the user's weight for fully flexing and decompressing the spine and strengthening the trunk and back muscles of the user. The station has a frame of tubular construction with a floor engaging base, front and rear vertical upright members, a horizontal top member extending between upper ends thereof, and a cushioned forearm pad on each said horizontal member with handgrips at outer of the horizontal top members. A lower pair of vertically spaced padded cross members extend transversely between the rear vertical upright members to serve as foot supports. A central upright member is connected at a lower end with at least one padded cross member and has a forward and angularly upward extending upper portion. A backrest pad is mounted the central upright member. An upper pair of parallel vertically spaced padded tubular members extend laterally outward from each side of the central upright member near its upper portion to selectively serve either as handgrips or as elevated or leg or foot supports when performing exercises. A removable rotatable cylindrical cushioned roller is may be mounted transversely between the horizontal top members to serve as a back engaging roller or a seating surface when performing exercises. Various auxiliary exercise apparatus may be removably connected with the station for performing a variety of exercises.

DESCRIPTION OF THE PREFERRED EMBODIMENTS

Figure 1:
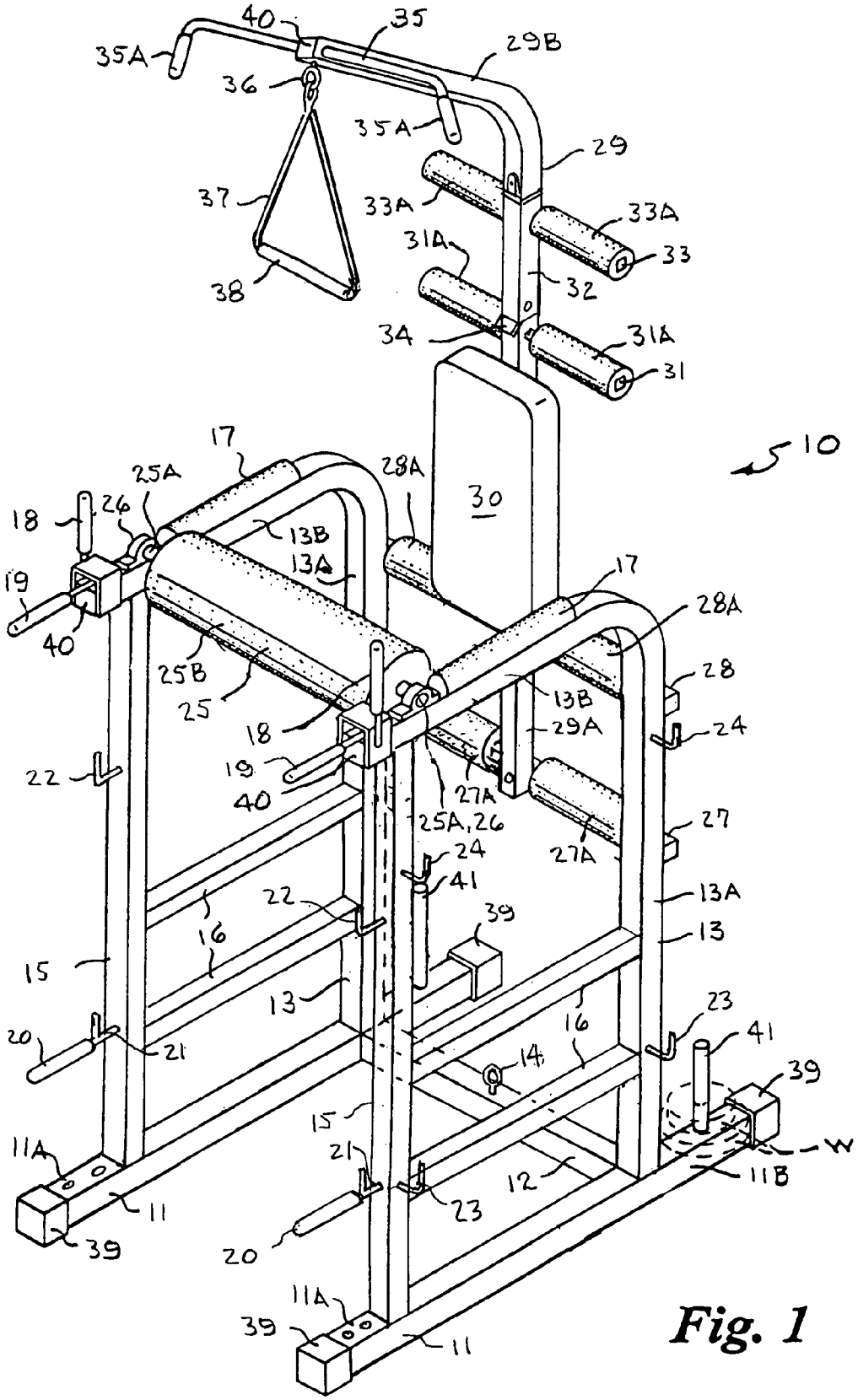
FIG. 1 is an isometric view of the back therapy and multiple exercise station in accordance with a preferred embodiment of the present invention.

Referring to the drawings by numerals of reference, there is shown in FIG. 1, a preferred a back therapy and exercise apparatus or station 10. The principle structural frame members of the station 10 are preferably constructed of square or rectangular cross section steel tubing, as is common practice for exercise equipment. The individual members are joined by welding or by mechanical fasteners as appropriate to facilitate assembly and disassembly, and compact storage and shipping.

The station 10 is supported on the floor by a pair of elongate tubular base members 11 joined together in parallel laterally spaced relation by a tubular base transverse cross member 12 near their rearward ends. A pair of tubular lateral rear upright members 13, having a generally inverted L-shaped configuration, are each connected at their bottom end to a respective base member 11 at its intersection with the transverse cross member 12. Each lateral rear upright member 13 has a longer vertical leg 13A and a shorter horizontal leg 13B that extends forward therefrom over the front portion 11A of the respective base member 11 in vertically spaced parallel relation. An eyebolt 14 may be secured to the base transverse cross member 12 for connecting elastic bands having handles for receiving the hands or feet of a user to perform various arm and chest exercises.

A pair of tubular lateral front upright members 15 are each connected at their bottom end to a respective base member 11 near its forward end and at their top end to the underside of a respective horizontal leg 13B of the rear upright members 13 to extend vertically therebetween in parallel relation. A pair of upper and lower tubular horizontal cross members 16 are connected at their outer ends to the front upright member and the vertical leg 13A of the rear upright members 13 at each side of the station 10 in parallel vertically spaced relation.

A cushioned forearm pad 17 is mounted on the top surface of the horizontal leg 13B of each lateral rear upright member 13. An upper dual grip member having a vertical handgrip 18 and a horizontal handgrip 19 is connected to the front end of the horizontal leg 13B of each lateral upright member 13. A lower horizontal handgrip 20 is connected to the front side of each front upright member 15 near its lower end and each has a vertical rod portion spaced a short distance from the front side to form a generally U-shaped lower support surface 21. A generally L-shaped rod member 22 is connected to the front side of each front upright member 15 a distance above the horizontal handgrip 20 with its vertical portion spaced a short distance from the front face to form a generally U-shaped upper support surface.

A generally L-shaped rod member 23 is connected to the outer side of each front and rear upright member 13 and 15 near their lower ends in laterally opposed relation with its vertical portion spaced a short distance from the outer side to form a generally U-shaped lower support surface on the side of the station 10. A generally L-shaped rod member 24 is connected to the outer side of each front and rear upright member 13 and 15 a distance above each lower member 23 in laterally opposed relation with its vertical portion spaced a short distance from the outer side to form a generally U-shaped upper support surface on the side of the station 10.

The lower and upper U-shaped support surfaces described above are used for connecting additional exercise apparatus to the station 10, as described hereinafter.

A cylindrical roller 25 is removably and rotatably mounted between the forward portions of the horizontal legs 13B of the lateral upright members 13 to extend transversely therebetween. The cylindrical roller 25 is constructed of a tubular bar 25A of circular cross section having its outer ends rotatably journalled in pillow blocks 26 or other conventional rotatable fasteners that are removably mounted on the top surface of the horizontal leg 13B of a respective lateral upright member 13 forward of the forearm pad 17. The pillow blocks 26 may be provided with depending pins that are received in holes in the horizontal legs 13B for quick installation and removal. A thick pad 35B formed of resilient cushioning material encircles the bar 25A between the pillow blocks 26. The exterior of the pad of the cylindrical cushioned roller 25 may be provided with a removable or replaceable cover that may have a smooth or textured surface or a surface containing resilient protrusions to provide stimulating therapeutic action while performing exercises. The interior of the cylindrical cushioned roller 25 may also contain one or more vibrating devices in its interior, which are conventional and therefore not shown, to provide additional therapeutic massaging action.

A lower pair of tubular transverse cross members 27 and 28, are each connected at their outer ends to the upper end of the vertical legs 13A of the lateral upright members 13 in parallel vertically spaced relation. A central upright member 29, having a longer vertical leg 29A and a shorter upper leg 29B that extends forward and angularly upward therefrom, is connected at the lower end of its vertical leg to the mid section of the transverse cross members 27 and 28, respectively. Pads 27A and 28A formed of a resilient cushioning material encircle the lateral portions of the transverse cross members 27 and 28 between the central upright member 29 and lateral upright members 13. A generally rectangular backrest pad 30 formed of a resilient cushioning material is mounted on the front side of the lower portion of the central upright member 29. The lower pair of padded cross members 27 and 28 are spaced vertically apart a sufficient distance such that a user may engage the top portion of his or her feet beneath them on the padded surfaces to support or suspend their body when performing various exercises.

A lower tubular member 31 is connected at its mid section to the upper portion of the vertical leg 29A of the central upright member 29 above the backrest pad 30 and its outer ends extend laterally outward from each side of the vertical leg 29A. A pad 31A formed of a resilient cushioning material encircle the lateral portions of the transverse cross member 31.

A pivot arm 32 formed of a length of generally U-shaped channel is pivotally connected at its lower end to the lateral sides of the vertical leg 29A of the central upright member 29 just above the lower tubular member 31 and straddles the vertical leg. The top end of the pivot arm 32 is releasably connected to the front side of the vertical leg 29A by a conventional fastener, such as a bolt or latch pin. A tubular member 33 extends outwardly from each lateral side of the pivot arm 32 near its top end in laterally opposed relation. Pads 33A formed of a resilient cushioning material encircle the lateral portions of the tubular members 33.

When the top end of the pivot arm 32 is secured to vertical leg 29A, the upper and lower padded tubular members 31 and 33 are disposed in vertically spaced parallel relation to provide elevated cushioned surfaces on which a user may place the instep of his or her feet to support or suspend their body when performing various inversion exercises. When the top end of the pivot arm 32 is released, it pivots angularly outward and downward relative to the vertical leg 29A. A stop surface 34 is provided at the lower end of the pivot member 32 to engage the front side of the vertical leg 29A and control the extent of the pivotal movement to place the padded tubular members 33 near the center longitudinal axis of the station. In the deployed position, the upper padded tubular members 33 can serve as elevated cushioned handgrips whereby the user may grip them to perform various body lifting exercises such as pull-ups or chinning exercises.

A pull-up bar 35 of circular cross section extends through apertures near the outer end of the upper leg 29B of the central upright member 29 and is secured thereto by an eyebolt fastener 36. The sides of the pull-up bar 35 extend laterally outward from each side of the upper leg 29B and terminate in downward extended ends that are covered by handgrips 35A. An elastic cord 37 is looped through a short handle bar 38 and its outer ends are secured to the eyelet of the eyebolt fastener 36.

All of the exposed outer ends of the tubular structural frame members of the station 10 are provided with protective end caps 39 or end plugs 40. While the configuration and weight of the station frame is generally adequate to provide stability during performance of various exercises and prevent overturning, a pair relatively short vertical bars 41 are connected to the top side of the back portion 11B of the base members 11, respectively, for receiving auxiliary weights W such as disc-shaped weights of the type that are commonly used for barbells, when desired.

When installed on the station 10, the rotatable cylindrical roller 25 provides a cushioned back engaging surface and a seating surface for the user of the apparatus to carry out various therapeutic back exercises such as stretching, bending, twisting, extension and inversion exercises utilizing the user's weight for fully flexing and decompressing the spine and strengthening the trunk and back muscles of the user.

Figure 2:
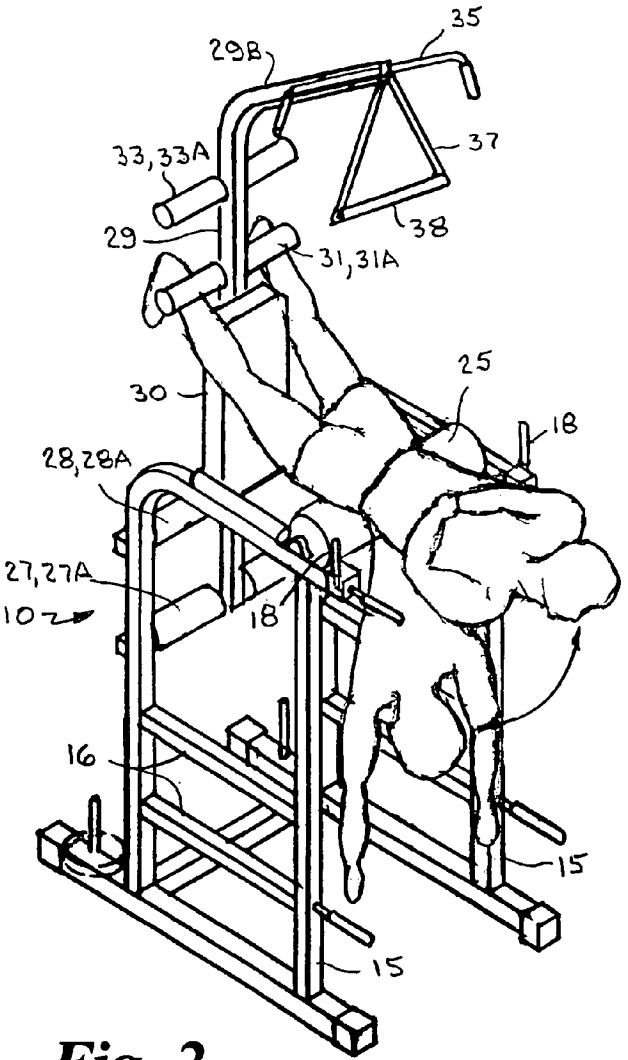
FIG. 2 is a perspective view showing, somewhat schematically, a user performing an exercise utilizing a roller installed on the exercise station.
Figure 5:
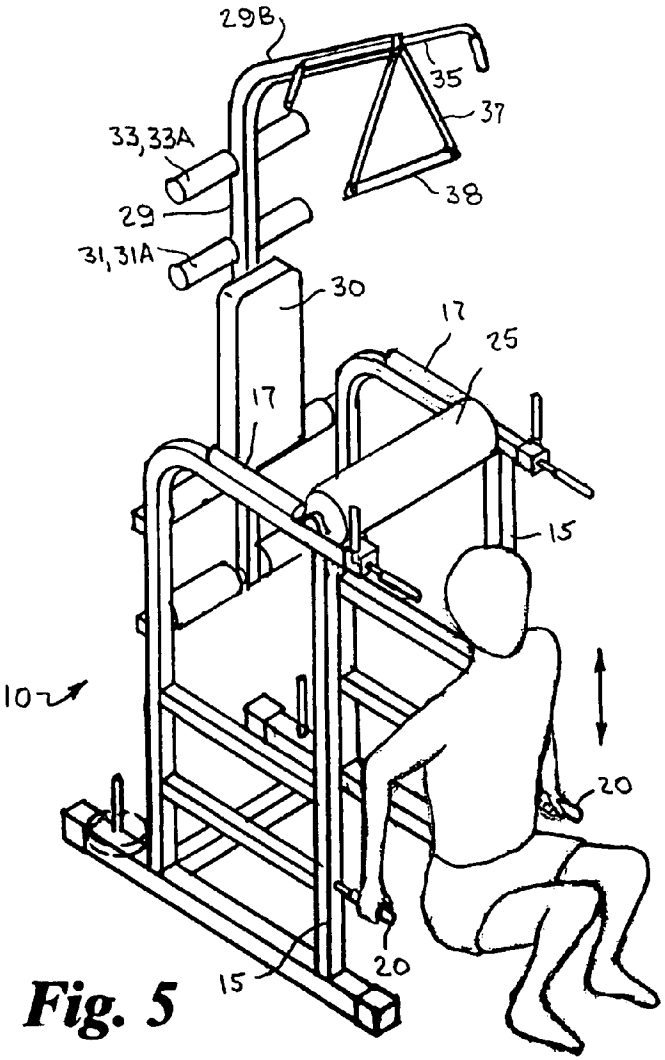
FIG. 5 is a perspective view showing, somewhat schematically, a user performing push-ups using the lower set of handgrips.

As shown somewhat schematically in FIG. 2, when the roller 25 is installed on the horizontal legs 13B, the user can stand on the upper or lower cross members 16 facing the roller and with their abdomen engaged on the roller, lean over the roller with while gripping the (inversion) vertical handgrips 18, contract their legs with their full body weight supported on the roller, and then engage the heels of their feet on an upper or lower leg rest 31 or 33 such that their body will be in an upside down or inverted position with their head below their feet. The user can also raise and lower their upper body between the inverted position and a horizontal position and perform several repetitions to flex and strengthen the back and abdominal muscles.

Figure 3:
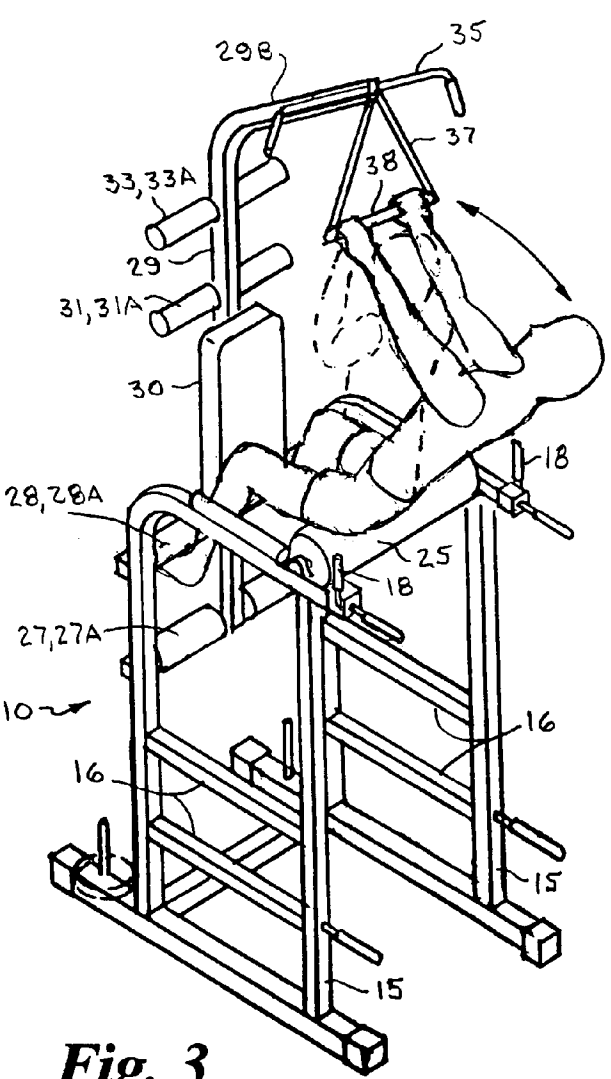
FIG. 3 is a perspective view showing, somewhat schematically, a user performing a second exercise utilizing the roller installed on the exercise station.

As shown in FIG. 3, this exercise can also be repeated with the user facing the reverse direction. The user can stand on the upper or lower cross members 16 facing the rear of the station and with lumbar area engaged on the roller (or sit on the roller), lean backwards over the roller while holding the handle bar 38 connected with the elastic cord 37, contract their legs with their full body weight supported on the roller, and then engage the insteps of their feet on an upper or lower leg rest 27 or 28 such that their body will be in an upside down or inverted position with their head below their feet. The user can also raise and lower their upper body between the inverted position and a horizontal position and perform several repetitions to flex and strengthen the back and abdominal muscles. In the rearward facing position the user can also stand on the upper or lower cross members 16 and, with lumbar area engaged on the roller, move up and down between a standing position and a squat or sitting position to flex the spinal vertebrae and massage the back.

The roller 25 may also be removed and mounted in holes in the front portion 11A of the base members 11. In this position, the user can lay on the floor and, with the their back resting on the roller, grip the lower handgrips 20 and move their body to and fro over the roller to flex the spinal vertebrae and massage the back.

Figure 4:
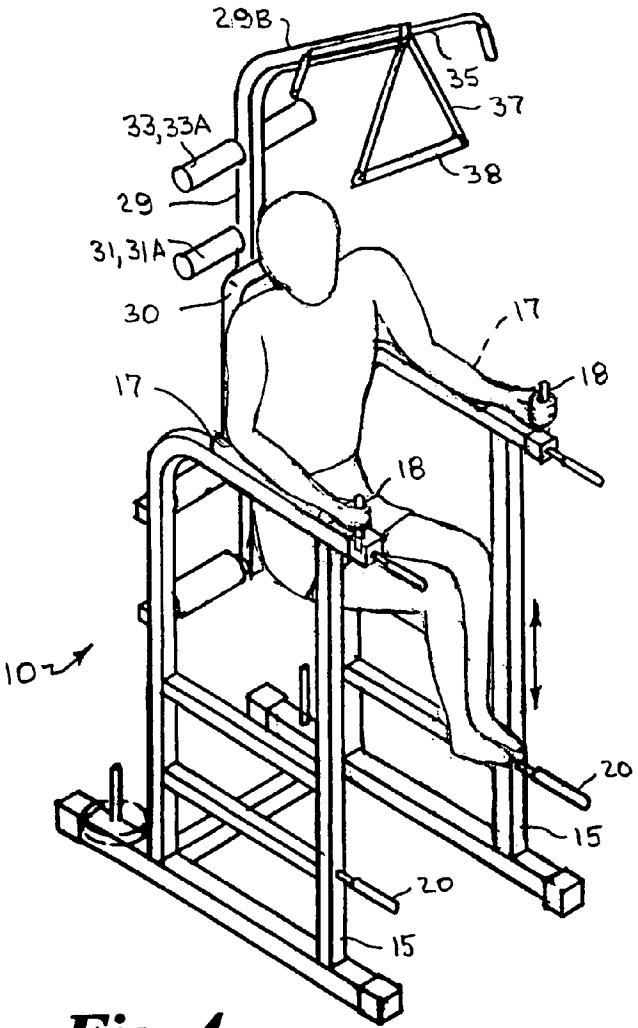
FIG. 4 is a perspective view showing, somewhat schematically, the station used and a vertical knee raise (VKR) station.

As shown in FIG. 4, when the rotatable cylindrical roller 25 is removed from the station 10, the user can use the station as a vertical knee raise (VKR) station. The backrest 30, forearm pads 17 and vertical handgrips 18 are used when performing vertical knee raises, leg raises and oblique twists. The upper horizontal handgrips 33 may be gripped to perform dips, and the pull-up bar 35 at the outer end of the upper leg 29B of the central upright member 29 is used to perform chin-up and pull-up exercises. The lower horizontal handgrips 20 at the front of the station 10 may be used to perform pushups or squats with the roller 25 installed or removed.

Various accessory exercise apparatus may be provided for connection to the station 10 for performing a wide variety of additional exercises.

Figure 7:
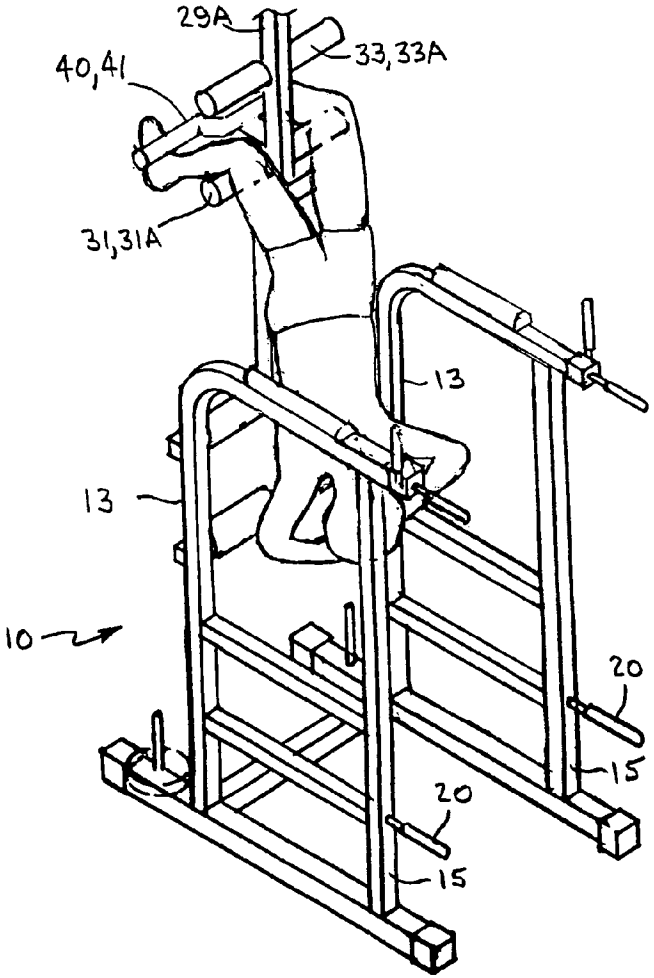
FIGS. 6 and 7 are a top plan view and a perspective view, respectively showing a tubular T-shaped foot support member connected to the exercise station for performing inversion exercises.
Figure 6:
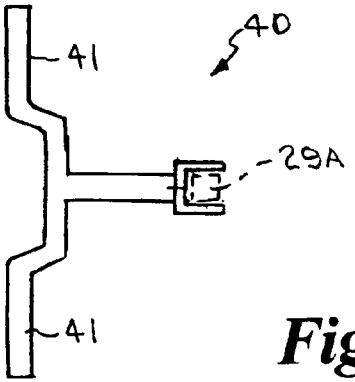

As shown somewhat schematically in FIGS. 6 and 7, a tubular T-shaped foot support member 40 may be secured by a bracket to the back side of the of the vertical leg 29A, which extends outwardly therefrom and has a pair of lateral round tubular members 41 at its outer end that are disposed approximately parallel with the lower padded tubular members 31 when the foot support member is installed. The user may place the top portion of their feet under the tubular members 41 and the back of their knees over the lower padded tubular members 31 and assume an inverted position such that their body will be supported with their head below their feet.

Figure 8:
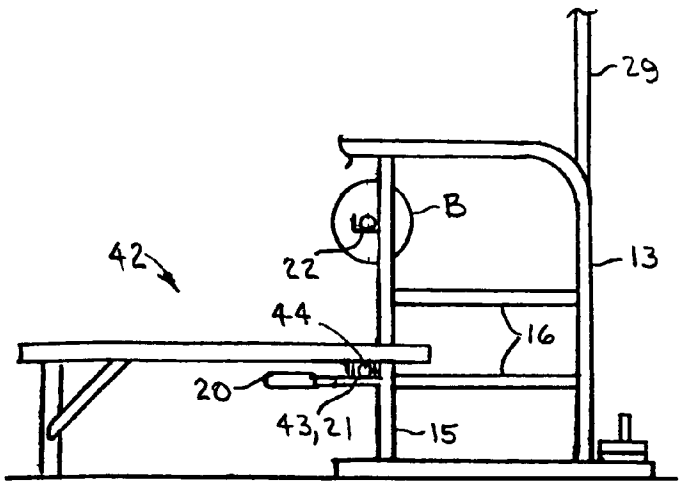
FIG. 8 is a side elevation view of a weight bench apparatus connected with the exercise station.

FIG. 8 is a side elevation view showing a generally rectangular weight bench apparatus 42 connected with the exercise station 10. This is accomplished by placing a horizontal bar 43 into the lower U-shaped support surfaces 21 on the front lateral upright members 15 to extend transversely therebetween. The weight bench 42 is provided with an inverted U-shaped channel 44 near its front end that is removably supported on the bar 43. The upper U-shaped support surfaces 22 on the front lateral upright members 15 may be used to support a barbell B.

Figure 10:
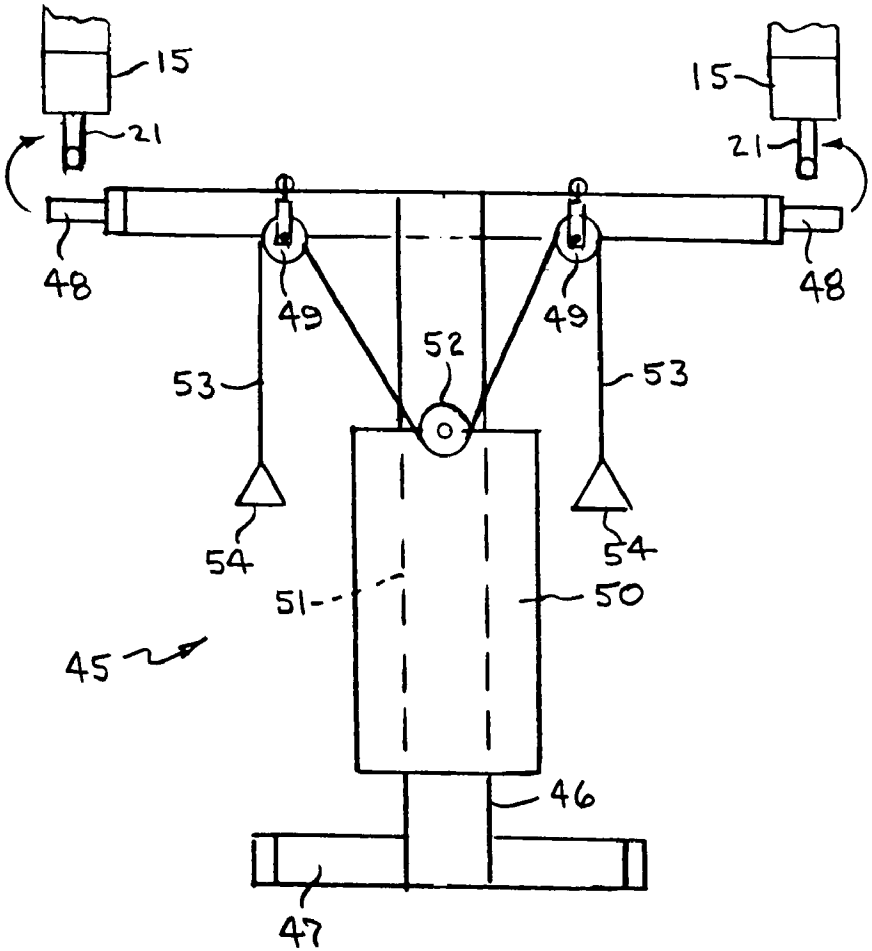
FIGS. 9 and 10 are a side elevation view and a top plan view, respectively, showing somewhat schematically, an inclined plane carriage apparatus connected to the exercise station.
Figure 9:
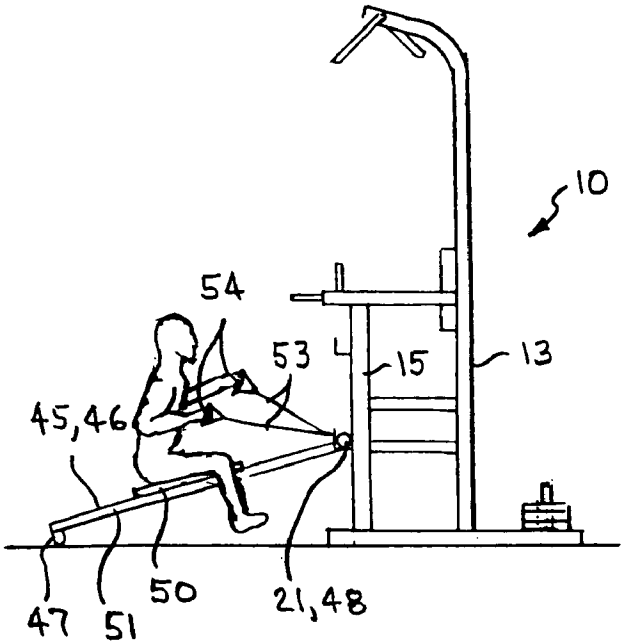

FIGS. 9 and 10 are a side elevation and a top plan view, respectively, showing somewhat schematically, an inclined plane carriage apparatus 45 connected with the exercise station 10. The inclined plane carriage apparatus 45 has a rectangular platform 46 with a transverse bar 47 at one end which is supported on the floor and a transverse bar 48 at the opposed end which is supported at each end in the lower U-shaped support surfaces 21 on the front lateral upright members 15. A pair of pulleys 49 are mounted on the bar 49 a distance outwardly from the opposed sides of the platform 46. A mobile carriage 50 is mounted for reciprocal movement on a pair of spaced tracks 51 on the platform and has a pulley 52 at its forward end. An elongate cable 53 having handles 54 at each end is entrained around the three pulleys. A user may sit or lie on the carriage and undergo core muscle training by pulling on the cable to move the carriage and his or her body supported thereon against the force of gravity. The platform track and carriage roller elements are conventional in the art, and therefore not shown in detail.

Figure 11:
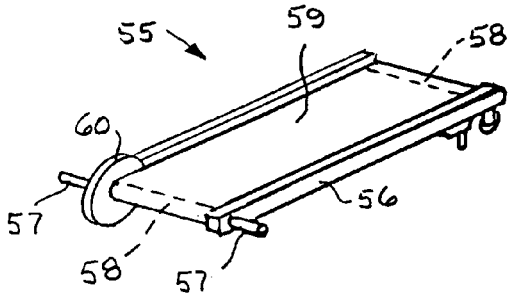
FIGS. 11 and 12 are an isometric view and a side elevation view, respectively, showing, somewhat schematically, a treadmill apparatus connected to the exercise station.
Figure 12:
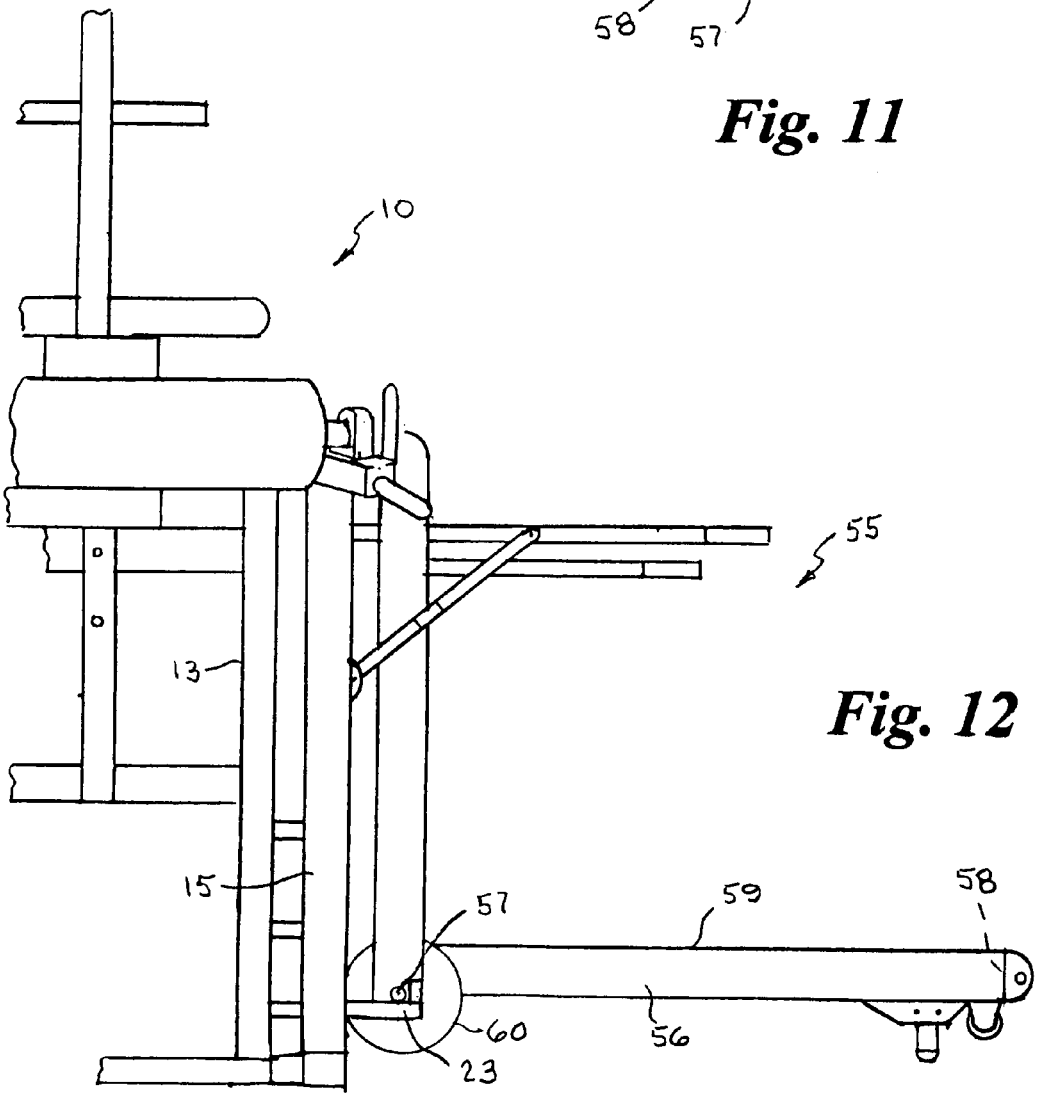

As shown somewhat schematically in FIGS. 11 and 12, a treadmill apparatus 55 may be connected to the side of the exercise station 10. The treadmill 55 has a rectangular frame 56 which is supported on the floor at one end and has a round bar 57 extending outwardly from laterally opposed sides at the opposite end which are supported in the lower U-shaped support surfaces 23 on the front and rear lateral upright members 13 and 15. A pair of rollers 58 are rotatably mounted one at each end of the frame 56, and an endless belt 59 is encircled around the rollers. The treadmill 55 is provided with a conventional flywheel 60 and resistance adjustment mechanisms, and may also be provided with additional mechanisms, such as digital displays, etc., which are conventional in the art and therefore not shown.

Figure 13:
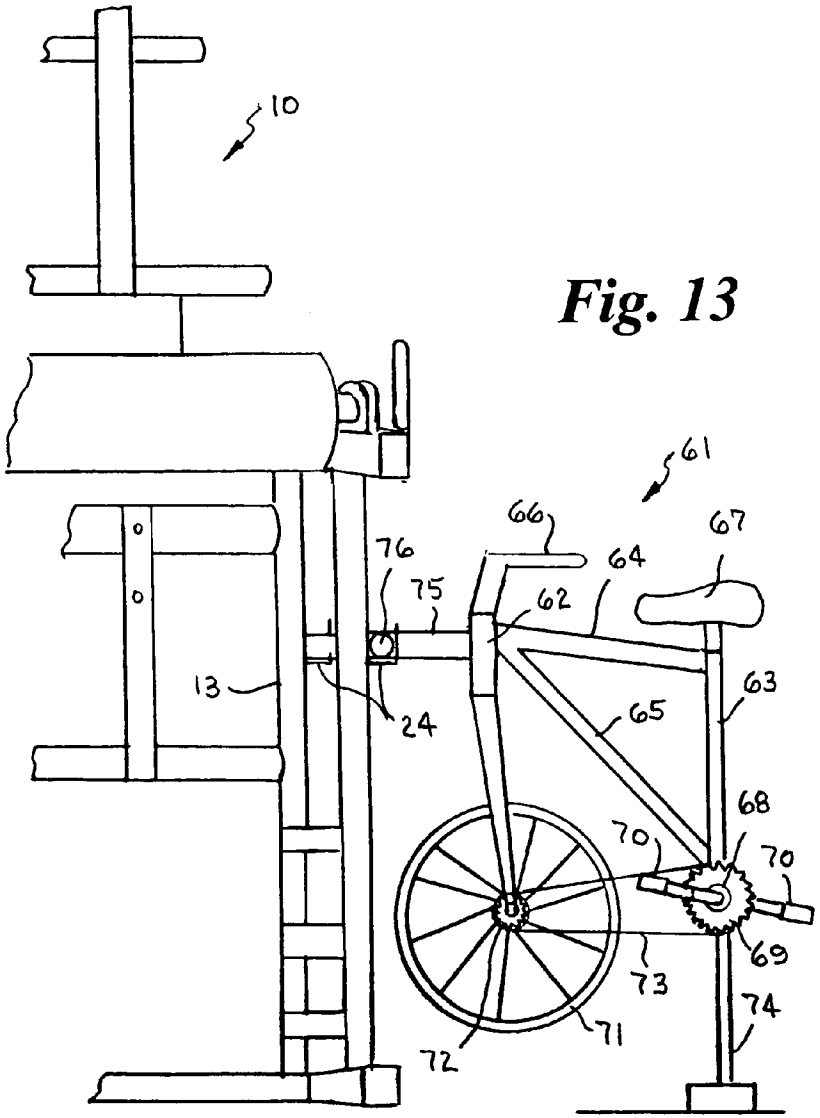
FIGS. 13 and 14 are a side elevation view and a top plan view, respectively, showing, somewhat schematically, an exercise bicycle apparatus connected to the exercise station.
Figure 14:
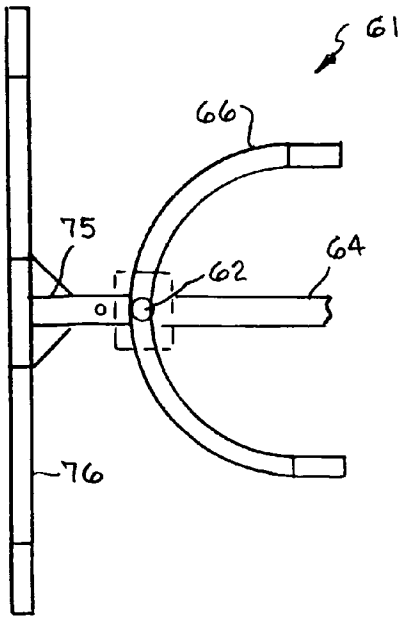

As shown somewhat schematically in FIGS. 13 and 14, an exercise bicycle apparatus 61 may be connected to the side of the exercise station 10. The exercise bicycle 61 has a conventional bicycle front frame including a head tube 62, a seat tube 63, a top tube 64, an angular down tube 65, handlebars 66, a seat 67, a bottom bracket shell 68 with a chain sprocket 69 and pedals 70. A front wheel 71 having a sprocket 72 is rotatably mounted in a yoke at the lower end of the head tube 62 and driven by a chain 73 entrained around the sprockets. A tubular inverted T-shaped base 74 extends downwardly from the bottom bracket shell 68 to engage the floor and support the back end of the exercise bicycle 61. A tubular T-shaped front support member 75 is secured to the head tube 62 and extends forwardly therefrom and has a transverse round bar 76 at its outer end which is supported in the upper U-shaped support surfaces 24 on the front and rear lateral upright members 13 and 15. The exercise bicycle 61 is provided with conventional resistance adjustment mechanisms, and may also be provided with additional mechanisms, such as digital displays, etc., which are conventional in the art and therefore not shown.

Figure 16:
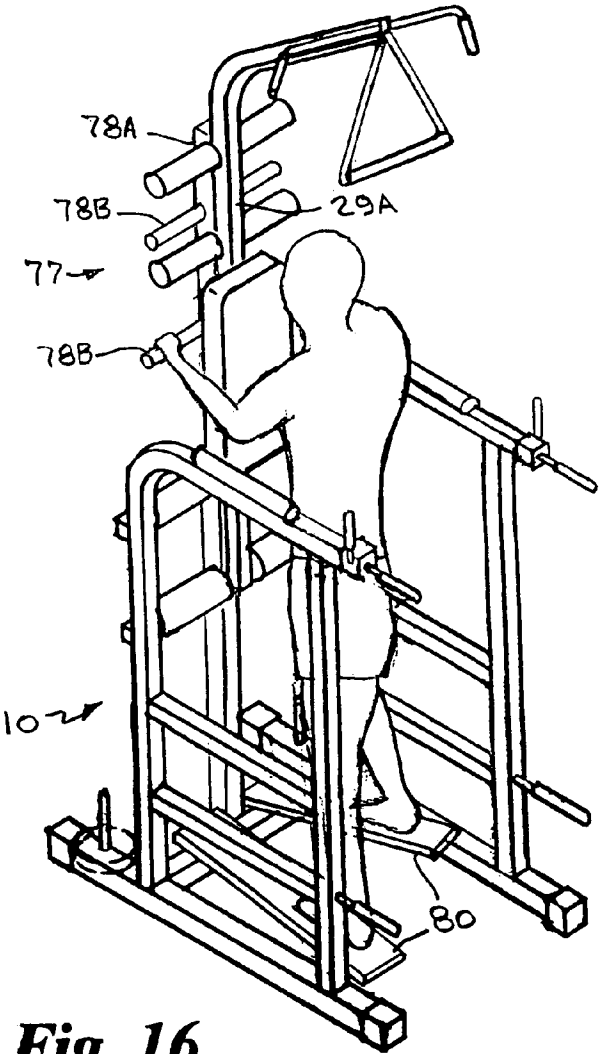
FIGS. 15 and 16 are isometric views showing, somewhat schematically, a stair stepping apparatus connected to the exercise station.
Figure 15:
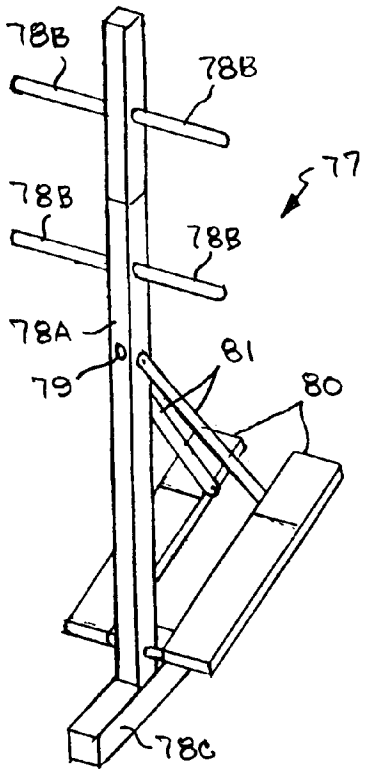

As shown somewhat schematically in FIGS. 15 and 16, a stair stepping apparatus 77 may be connected to the exercise station 10. The stair stepping apparatus 77 has a generally L-shaped frame with a vertical tubular member 78A having laterally extending handgrips 78B and a horizontal tubular base member 78C at its bottom end that engages the floor. The vertical tubular member 78A may be secured to the vertical leg 29A of the station 10 by passing a bolt through holes 79 in the vertical tubular member and the vertical leg 29A and securing it with a nut. The stair stepping apparatus 77 has a pair of laterally spaced foot platforms 80 pivotally mounted at one end on the frame and connected at their back end to the vertical tubular member 78A by pivotally mounted oil or air filled shocks 81 extending therebetween. The laterally spaced foot platform pivotal mounting, shock mounting and resistance adjustment mechanisms are conventional in the art and therefore not shown.

Figure 18:
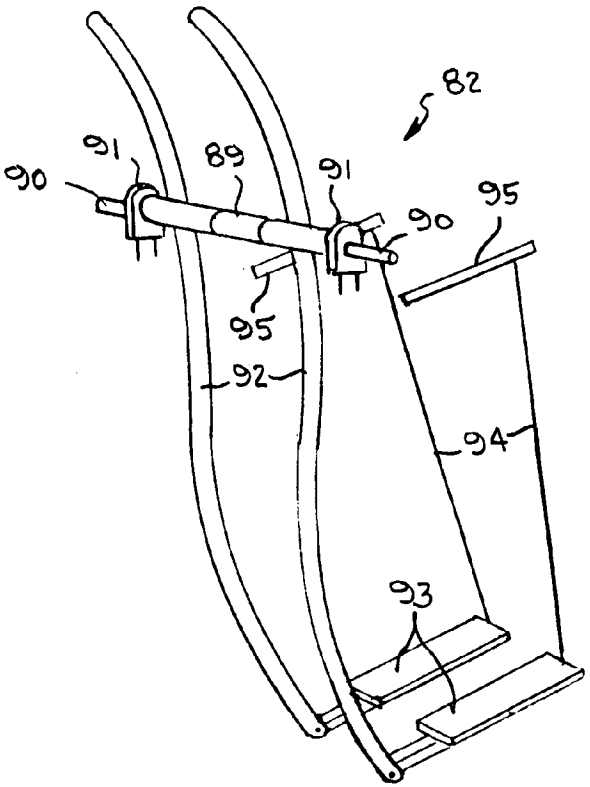
FIGS. 18 and 19 are an isometric view and a side elevation view, respectively, showing somewhat schematically, a striding apparatus connected to the exercise station.
Figure 19:
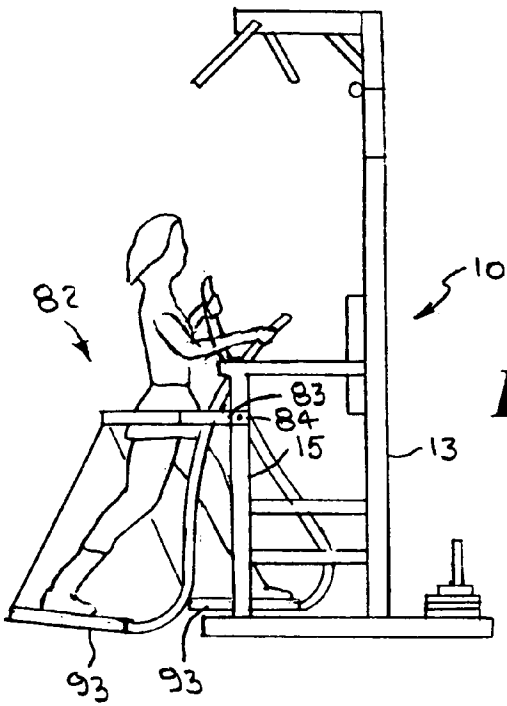
Figure 17:
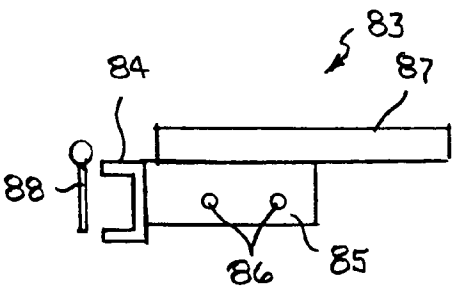
FIG. 17 is a top plan view of one of a pair of mounting brackets used for mounting a striding apparatus to the exercise station.

As shown somewhat schematically in FIGS. 17, 18 and 19, a striding apparatus 82 may be connected to the exercise station 10. A pair of brackets 83 are provided that have a U-shaped member 84 which straddles a respective front lateral upright member 15, a first tubular extension 85 extending outwardly therefrom having holes 86 therethrough, and a second longer tubular extension 87 secured to the outer side of the first extension. The brackets 83 are secured to the lateral upright members 15 by a latch pin 88 passed through holes in the U-shaped member 84 and upright member 15. The striding apparatus 82 has a horizontal tubular bar 89 with independently rotatable outer ends 90 that are journalled in pillow blocks 91 having depending pins, which are removably mounted on the first tubular extension 85 for quick installation and removal. The striding apparatus 82 has a pair of elongate handles 92 connected to the rotatable ends 90 of the bar 89 and a pair of laterally spaced foot platforms 93 each pivotally connected at a front end to the bottom end of a respective handle 93. A pair of link members 94 each pivotally connected at the back end of a respective foot platform 93 extend upward therefrom and have a horizontal tubular member 95 pivotally connected to their top ends that extends forwardly therefrom. The outer end of each horizontal tubular member 95 is received in a respective second tubular extension 87 of the mounting brackets 83 such that the foot platforms are suspended a distance above the floor surface. The rotating and pivotal connections are conventional in the art and therefore not shown in detail.

Figure 20:
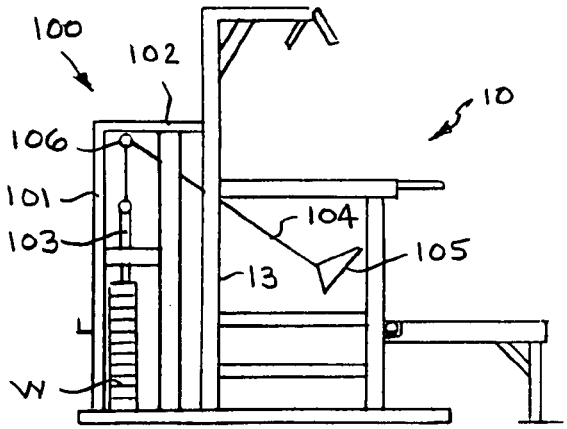
FIGS. 20 and 21 are side and rear elevation views, respectively, showing somewhat schematically, a cable-type weight stack apparatus connected to the exercise station.
Figure 21:
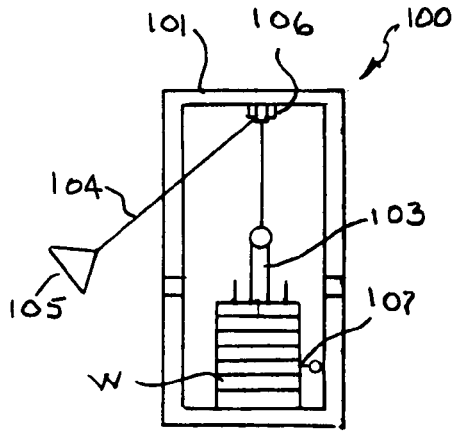

As shown somewhat schematically in FIGS. 20 and 21, a weight stack apparatus 100 may be connected to the exercise station 10. The weight stack apparatus 100 has a generally rectangular open frame 101 which is supported on the floor at the back of the station 10 and has a pair of laterally spaced tubular extensions 102 extending outwardly therefrom that are connected to the rear upright members 13. A stack of weights W are movably supported for vertical movement in the frame 101, and a link member 103 extends through the weights. An elongate cable 104 is connected at one end to the link member 103 and has a handle 105 at its free end. The cable 104 passes over a pulley 106 at the upper end of the frame 101. The weight stack is provided with a latch pin member 107 that engages or releases a selected number of weights to adjust the amount of weight being lifted. The internal latching mechanism is conventional in the art and therefore not shown.

Figure 22:
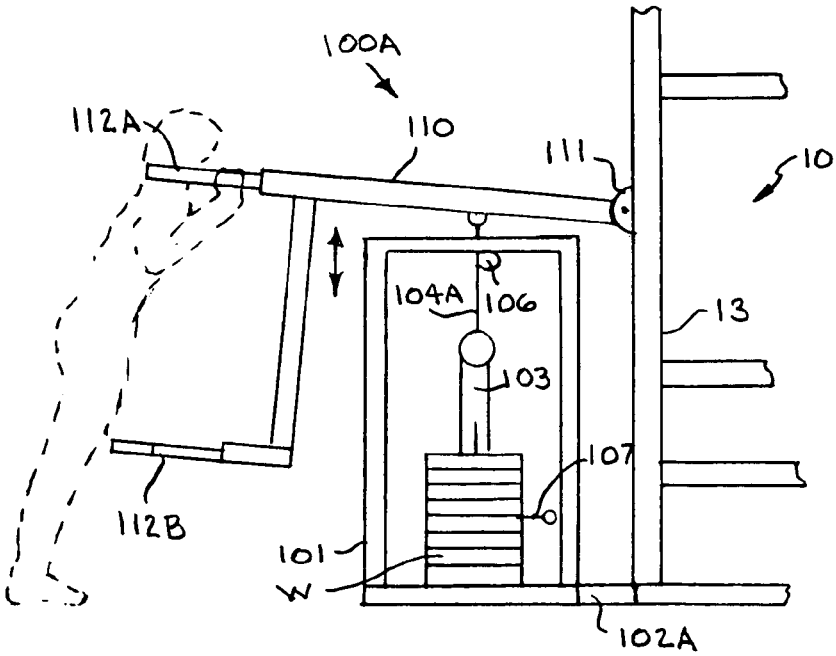
FIG. 22 is a side elevation view showing, somewhat schematically, a lever-type weight stack apparatus connected to the exercise station.

FIG. 22 shows somewhat schematically, a pivoting lever weight stack apparatus 100A connected to the exercise station 10. The weight stack apparatus 100A has a generally rectangular open frame 101 which is supported on the floor at the back of the station 10 and has a pair of laterally spaced tubular extensions 102A extending outwardly from a bottom end that are connected to the rear upright members 13. A lever arm 110 is pivotally connected at one end to a bracket 111 mounted at the upper end of a respective rear upright member 13 and extends outwardly above the frame 101. The outer end of the lever arm 110 is provided with an upper and lower pair of handgrips 112A, 112B. A stack of weights W are movably supported for vertical movement in the frame 101, and a link member 103 extends through the weights. An elongate cable 104A is connected at one end to the link member 103 and at its upper end to the lever arm 110 at its upper end. The cable 104A passes over a pulley 106 at the upper end of the frame 101. The weight stack is provided with a latch pin member 103 that engages or releases a selected number of weights to adjust the amount of weight being lifted. The interior latching mechanism is conventional in the art and therefore not shown.

While this invention has been described fully and completely with special emphasis upon preferred embodiments, it should be understood that within the scope of the appended claims the invention may be practiced otherwise than as specifically described herein.

The invention claimed is:

1. A freestanding back therapy and multiple exercise station on which performance of various therapeutic, stretching, bending, twisting, extension and inversion exercises may be carried out utilizing the user's weight for fully flexing and decompressing the spine and strengthening the trunk and back muscles of the user, comprising:

a frame of tubular construction having a pair of generally rectangular laterally spaced sides, each of said sides formed of a straight elongate horizontal tubular floor engaging base member having front and rear ends, a front vertical tubular member and a rear vertical tubular member each secured at a bottom end to said base member intermediate its ends and extending upwardly therefrom in parallel spaced relation, a tubular horizontal top member extending between upper ends of said front and rear vertical tubular members, a cushioned forearm pad on each said horizontal top member, and an upper dual grip member having a vertical handgrip and a horizontal handgrip at an outer end of each said horizontal top member;

a pair of lower horizontal handgrips each extending outwardly from a front side of each said front vertical tubular member a distance below said upper dual grip member to be gripped by a user when performing exercises and each having a support surface adjacent to said front vertical tubular member for receiving and supporting objects thereon;

a first and a second pair of parallel vertically spaced padded tubular cross members connected at opposed ends with each said rear vertical tubular member and extending transversely therebetween to serve as lower foot supports for supporting a user when performing various exercises;

a central tubular upright member having an elongate vertical lower portion disposed centrally between said rear vertical tubular members connected at a lower end with said first and second padded tubular cross members and extending vertically upward therefrom parallel with said rear vertical tubular members, a backrest pad mounted on a front side of said vertical lower portion, a tubular upper portion above said backrest pad extending angularly upward and forward from said vertical lower portion, and a third pair of padded tubular members above said backrest pad extending laterally outward from opposed sides of said vertical lower portion to selectively serve either as handgrips or as elevated leg or foot supports when performing exercises;

a pull-up bar at an outer end of said central tubular upright member upper portion having opposed ends extending laterally outward from each side thereof to be gripped by the user when performing exercises;

a pivot arm pivotally connected at a lower end to said central tubular member vertical lower portion above said backrest pad and having a top end releasably connected with said vertical lower portion, and a fourth pair of padded tubular members extending laterally outward from opposed sides of said pivot arm, said pivot arm being selectively positionable between a first position generally parallel with said vertical lower portion, wherein said fourth pair and said third pair of padded tubular members are aligned in substantially parallel vertically spaced relation to provide elevated foot support surfaces on which the user may place the instep of his or her feet to support or suspend their body when performing inversion exercises, and a second position extending angularly upward and forward from said vertical lower portion, wherein said fourth pair of padded tubular members are disposed near the center of said frame to serve as elevated handgrips to be gripped by the user when performing body lifting exercises;

a cylindrical cushioned roller removably and rotatably mounted at opposed ends between said frame laterally spaced sides to extend transversely therebetween to serve as a back engaging roller or a seating surface when performing exercises;

said cylindrical cushioned roller positioned relative to said first and second pair of parallel vertically spaced padded tubular cross members extending between said rear vertical tubular member and said third pair of padded tubular members above said backrest to allow the user to selectively engage their feet on either of said first and second pair of padded tubular cross members or on said third pair of padded tubular members and selectively support either of their lumbar area or abdomen on said roller such that their upper body will be in an inverted position with their head below their feet; and foot supports on said laterally spaced sides on which the user may stand to assume positions on said roller or when performing exercises.

2. The exercise station according to claim 1, further comprising:

an elastic cord connected at one end with said central tubular upright member and having a handlebar at a free end to be gripped by a user when supported on said cylindrical cushioned roller and performing exercises.

3. The exercise station according to claim 1, further comprising:

a generally U-shaped upper support surface on a front side of each said front vertical tubular member near its upper end for receiving and supporting objects a barbell thereon; and a generally rectangular weight bench removably supported at one end on said support surfaces of said pair of lower handgrips and having an opposed end supported on floor engaging legs.

4. The exercise station according to claim 1, further comprising:

a generally U-shaped lower support surface on an outer facing lateral side of each of said front and rear vertical tubular member near their lower end and a generally U-shaped upper support surface on an outer facing lateral side of each of said front and rear vertical tubular member near their upper end for receiving and supporting objects thereon.

5. The exercise station according to claim 1, further comprising:

a vertical weight supporting bar on each said floor engaging base member near its said rear end for removably receiving and supporting selected auxiliary weights to provide additional stability of said frame during performance of exercises and prevent overturning of said frame.

6. The exercise station according to claim 1, further comprising:

a weight stack apparatus having a generally rectangular open frame supported at a bottom end on a floor surface and tubular extensions on lateral sides removably connected to said rear vertical tubular members, a stack of weights movably supported for vertical movement in said weight stack frame, a link member extending through said weights, a pulley at an upper end of said weight stack frame, and an elongate cable connected at one end with said link member passing over said pulley and having a handle at its free end.

7. The exercise station according to claim 1, further comprising:

a weight stack apparatus having a generally rectangular open frame supported at a bottom end on a floor surface and tubular extensions on lateral sides removably connected to said rear vertical tubular members;

a lever arm pivotally connected at one end to said at rear vertical tubular members near an upper end thereof and extending outwardly above said weight stack frame, and at least one pair of handgrips at an outer end thereof; and a stack of weights movably supported for vertical movement in said weight stack frame, a link member extending through said weights, a pulley at an upper end of said weight stack frame, and an elongate cable connected at one end with said link member passing over said pulley and connected at a second end to said lever arm.

8. The exercise station according to claim 1, further comprising:

a generally T-shaped foot support member having a central arm connected at one end with said central tubular member vertical lower portion above said backrest pad to extend outwardly therefrom and having a fifth pair of padded tubular members extending laterally outward from the outer end of said central arm disposed in substantially parallel horizontally spaced relation to said third pair of padded tubular members to provide elevated foot support surfaces under which the user may place the instep of his or her feet with the back of their knees supported over said third pair of padded members to support or suspend their body when performing inversion exercises.

9. The exercise station according to claim 1, further comprising:

a pair of brackets, each having a U-shaped portion that straddles a respective said front vertical tubular member and is secured thereto by a latch pin passed through holes in said U-shaped portion and said vertical tubular member, and each having a tubular extension extending outwardly therefrom for receiving and supporting objects thereon.

* * * * *